US005911480A

United States Patent [19]

Morgan

[11] Patent Number: 5,911,480

[45] Date of Patent: Jun. 15, 1999

[54] RAZOR HAVING EXTENDABLE HANDLE WITH ADJUSTABLE POSITIONS

[75] Inventor: Danny K. Morgan, Foster, Ky.

[73] Assignee: The Morgan Family Ministries, Inc., Foster, Ky.

[21] Appl. No.: 08/976,067

[22] Filed: Nov. 21, 1997

[51] Int. Cl.[6] ..... B26B 21/00; B26B 21/44; B26B 21/52

[52] U.S. Cl. ..... 30/41; 30/125; 30/526

[58] Field of Search ..... 30/41, 151, 526, 30/537, 125; 16/115

[56] References Cited

U.S. PATENT DOCUMENTS

| | | | |
|---|---|---|---|
| D. 260,191 | 8/1981 | Chase et al. . | |
| D. 309,036 | 7/1990 | Cheng . | |
| 1,749,051 | 3/1930 | Watt | 30/526 |
| 1,755,646 | 4/1930 | Halstead | 30/151 |
| 3,703,765 | 11/1972 | Perez | 30/41 |
| 3,895,437 | 7/1975 | DiBuono | 30/537 |
| 4,074,428 | 2/1978 | Roberts . | |
| 4,129,942 | 12/1978 | Denizman . | |
| 4,182,031 | 1/1980 | Cecil . | |
| 4,905,372 | 3/1990 | Willis . | |
| 5,014,427 | 5/1991 | Byrne | 30/41 |
| 5,167,069 | 12/1992 | Quinn . | |
| 5,704,127 | 1/1998 | Cordio | 30/526 |

FOREIGN PATENT DOCUMENTS

| | | | |
|---|---|---|---|
| 274299 | 7/1927 | United Kingdom | 30/FOR 100 |

*Primary Examiner*—Hwei-Siu Payer
*Attorney, Agent, or Firm*—Dinsmore & Shohl LLP

[57] ABSTRACT

A razor having an extendable, telescoping handle is provided wherein the handle has at least one telescoping segment which is slidingly movable and frictionally securable to a number of extendable positions. Preferably, the handle is flexible and resilient to allow the razor blade to conform closely to the contours of the body portion being shaved. The telescoping handle can be removed and secured to a variety of razors, such as disposable razors.

18 Claims, 6 Drawing Sheets

RAZOR HAVING EXTENDABLE HANDLE WITH ADJUSTABLE POSITIONS

TECHNICAL FIELD OF THE INVENTION

The present invention relates generally to shaving devices such as razors, and more specifically to razors having telescoping extendable handles for increasing the reach of the user of the razor.

BACKGROUND OF THE INVENTION

Disposable razors and safety razors are commonly used by consumers for shaving various bodily parts such as faces, and legs. However, such razors have the disadvantage of being limited in their overall reach due to the fact that the length of the handle of the typical razor is designed to only fit within the palm of the user's hand, such that the razor head is close to the user's hand. Thus, using such razors to reach remote locations of the body, such as the lower portions of the legs, can require much effort and discomfort, especially for a person who has a physical disability, is overweight, or is pregnant.

To address this problem, an extendable razor handle has been developed which extends the overall reach of the razor and thereby facilitates the shaving procedure. This device is disclosed in U.S. Pat. No. 5,167,069 issued to Quinn, which discloses a telescopically extendable and retractable body having a manual handle at one end and a pivoting razor shaving assembly at the opposite end. The body consists of a first and second tubular member which are telescopically interconnected, the first tubular member being pivotally connected to the shaving assembly support arm and the second tubular member being inserted into the handle assembly. The telescoping connections between the first and second tubular members and the handle assembly enable the apparatus to be extended to three different lengths depending on the needs of the user. The first and second tubular members are spring-biased by a coil spring to their telescopically extended positions from the handle assembly.

While the device disclosed in the '069 patent has the advantage of extending the reach of the user, it is not without disadvantages. For example, the handle is capable of extending to merely two positions, and therefore is limited in its ability to accommodate the reach of various users, as well as its ability to reach a variety of different bodily surfaces. Moreover, the device requires the use of a spring coil, to provide the extension capability, and, therefore, is subject to break down when the spring coil wears out. Also, the spring coil increases the cost of the device as well as the time required in its manufacture and assembly. In addition, the patent does not disclose an extendable handle that is flexible so as to allow the shaving blades to more accurately follow the contours of the body portion being shaved.

U.S. Pat. No. 4,905,372, issued to Willis, discloses a razor handle extension which can be adapted to detachably connect to the handle of a disposable razor to increase the length of the handle and to permit the user to more easily shave various bodily parts. However, the patent does not disclose a handle which is telescopically extendable to a number of positions so as to accommodate a variety of users in a variety of uses, nor does the patent disclose a flexible handle for a closer shave.

SUMMARY OF THE INVENTION

Accordingly, it is a primary object of the present invention to provide a telescopically extendable razor handle which is extendable to an infinite number of lengths so as to accommodate a variety of users and uses.

Another object of the invention is to provide a razor handle extension which is extendable without the use of extraneous parts which can be expensive and subject to break down.

Yet another object of the present invention is to provide a telescopically extendable razor handle which is flexible so as to allow the razor blades to more accurately conform to the contours of the user's body during shaving.

Another object of the invention is to provide an extendable reach razor which allows for the storage of razor blades and other shaving accessories.

Yet another object of the invention is to provide a razor which improves the reach of the user as well as allows for the dispensing of shaving cream through the head of the razor.

Another object of the invention is to provide an extendable razor handle which can be adapted to fit a variety of razors and shaving devices.

To achieve the foregoing and other objects and in accordance with the purposes of the present invention as described above, a device is provided for shaving hair from a body, comprising a head portion and an extendable handle portion. The head portion is adapted to secure at least one razor blade for shaving hair from a body, the at least one razor blade having a sharp edge portion extending away from the head portion. The extendable handle portion is connectable to the head portion and is extendable therefrom, and has a first segment and at least one telescoping segment. The at least one telescoping segment telescopically engages with the first segment and has a surface that is slidingly movable and continuously frictionally securable with respect to a surface of the first segment, such that the telescoping segment can be slid and secured to a plurality of partially extended positions with respect to the first segment. Preferably, at least a portion of the extendable handle portion is flexible and elastic.

To achieve the above mentioned objectives, there is also provided a telescoping extension handle for extending the reach of a razor, the handle comprising a first segment which is securable to the razor, and at least one telescoping segment. The at least one telescoping segment is telescopically engageable with the first segment, and has a surface that is slidingly movable and continuously frictionally securable with respect to a surface of another segment, such that the telescoping segment can be slid and secured to a plurality of partially extended positions with respect to the other segment. It is preferred that at least a portion of the handle is flexible and elastic.

Still other objects of the present invention will become apparent to those skilled in this art from the following description wherein there is shown and described preferred embodiments of this invention, simply by way of illustration, of the best modes contemplated for carrying out the invention. As will be realized, the invention is capable of other different embodiments without departing from the scope of the invention. Accordingly, the drawings and description should be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principals of the invention. In the drawings.

Reference will now be made in detail to the present preferred embodiments of the invention, examples of which are illustrated in the accompanying drawings wherein like numerals indicate similar elements throughout the views.

DETAILED DESCRIPTION OF PREFERRED EMBODIMENTS

Figure 1:
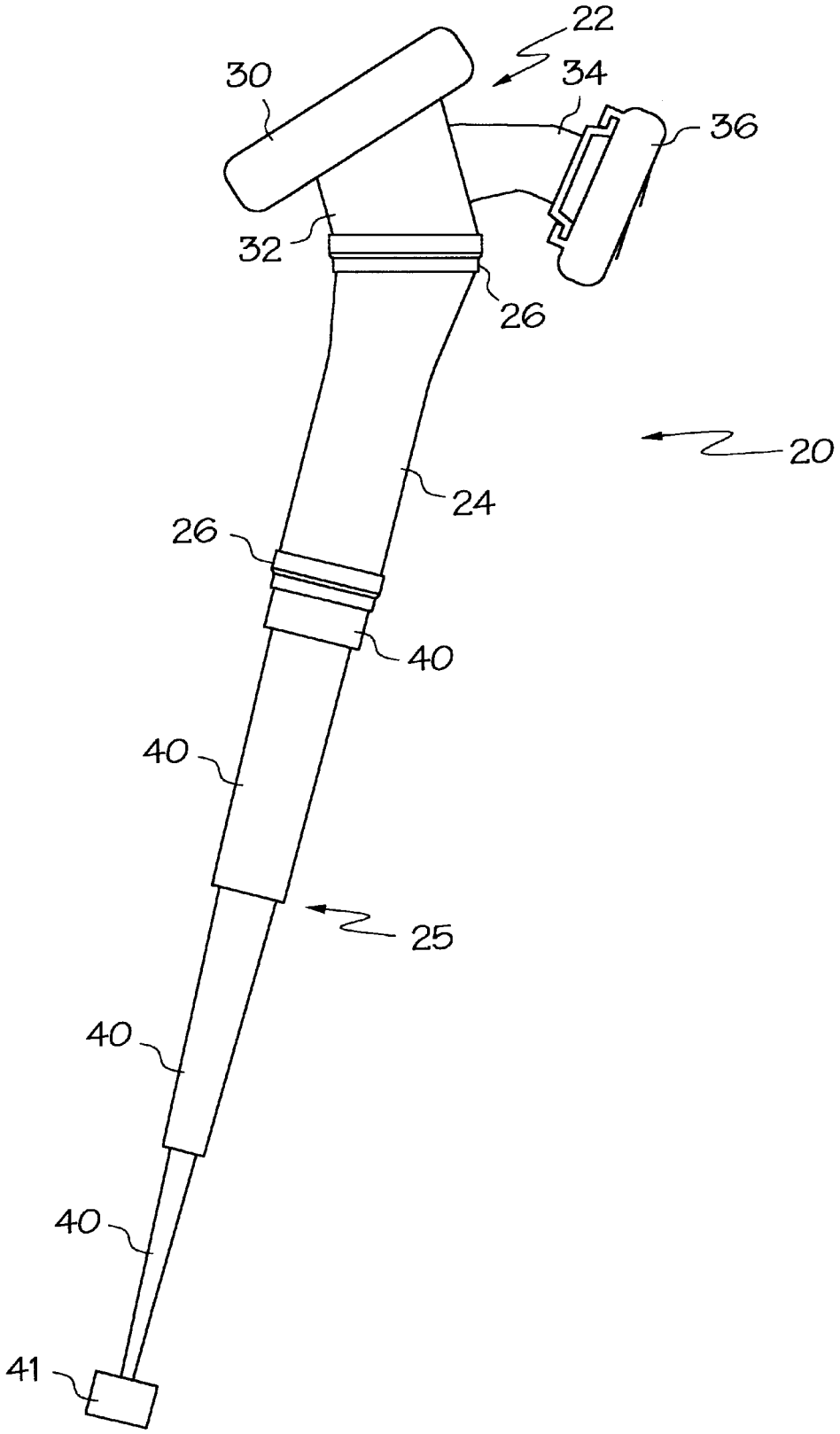
FIG. 1 is a side view of a razor having an extendable telescoping handle and a sponge applicator, according to one embodiment of the present invention.

Referring now to the drawings in detail, FIG. 1 is a side view of an embodiment of an extendable razor 20 of the present invention. The razor 20 includes a head portion 22, a main handle portion 24 and a telescoping handle portion 25. The head portion 22 is secured to the main handle portion 24 through the use of a brace member 26, which can comprise a locking ring or nut, flexible locking wrap material (such as shrink tape), a clamping device, or other device or material well known in the art for connecting various components. Similarly, the main handle portion 24 and the telescoping handle 25 are connected through the use of a second brace member 26.

The head portion 22 includes a base 32 to which is connected a sponge applicator 30 at one end, and a cartridge holder 34. The sponge applicator 30 can be used to apply shaving cream, lotion, gel and the like to the user's body. The cartridge holder 34 detachably connects to a blade cartridge 36 which holds razor blades for shaving hair on the user's body. As noted, the cartridge 36 is detachable such that when the blades become worn, the old cartridge may be removed and discarded and a new cartridge may be inserted. However, it is to be understood that a conventional head assembly may be used having traditional replaceable razor blades, without departing from the scope of the invention.

The main handle portion 24 interconnects the head assembly 22 and the extendable handle portion 25, a bore extends axially through the center of main handle portion 24 so as to telescopically receive the telescoping handle portion 25. The main handle portion 24 preferably receives nearly the entire telescopic portion 25 within the bore, such that only the end portion 41 protrudes from the main handle portion when the telescopic portion 25 is fully collapsed. However, it is to be understood that the main handle portion 24 may receive only a portion of the telescopic portion 25 without departing from the scope of the invention. The main handle portion 24 may comprise a variety of materials known in the art, such as metal, plastic, or fiberglass for example.

Figure 2:
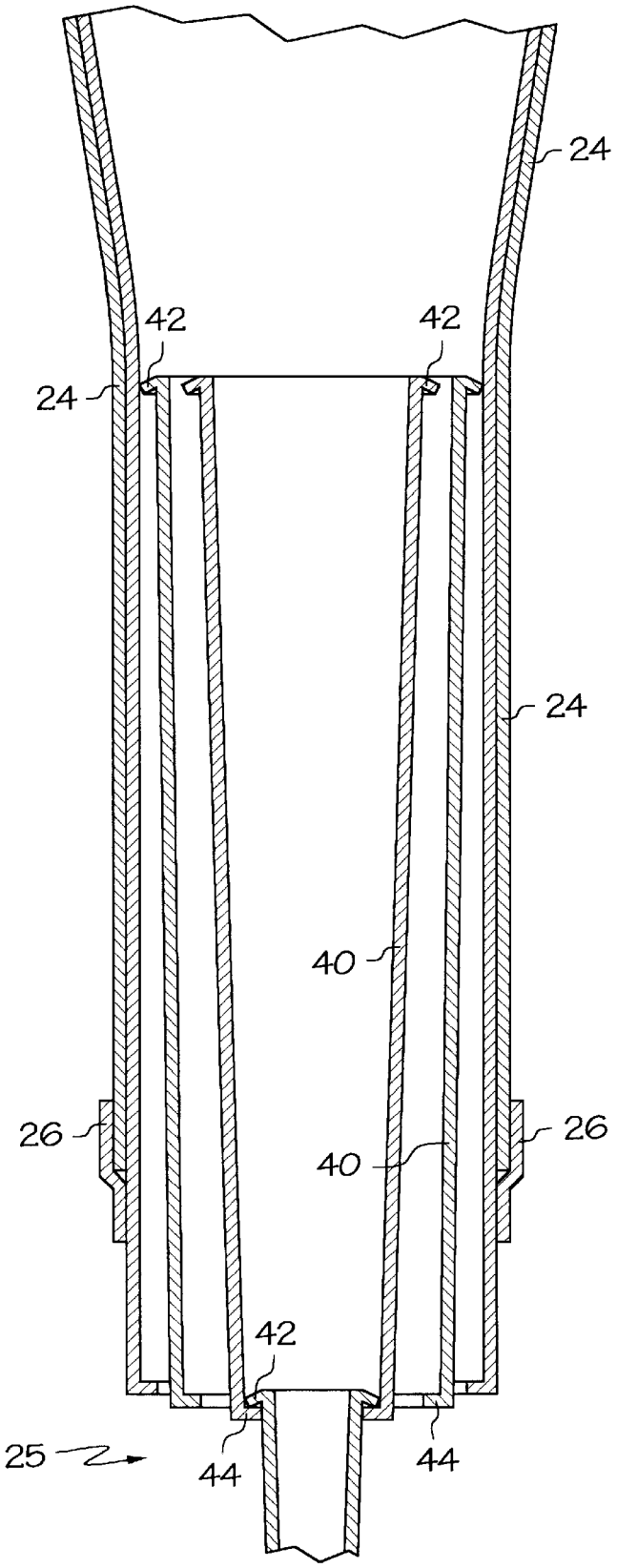
FIG. 2 is a cross sectional view of the razor of FIG. 1.

The telescoping handle portion 25 comprises a plurality of segments 40 which are telescopically interconnected, so as to receivingly engage one another, as best shown in FIG. 2. As shown in FIG. 2, each telescoping segment 40 can have an outwardly extending rim 42 at one end and an inwardly extending rim 44 at an opposite end. Accordingly, each outwardly extending rim frictionally and slidingly engages the inner wall of a telescoping segment 40 having a larger diameter, such as is known in the art of telescoping devices such as antennas. When a telescoping segment 40 is extended fully, the outwardly extending rim 42 of the ;segment engages the inwardly extending rim 44 of the next largest segment 40 so as to prevent the smaller segment from being removed completely from the larger segment. Moreover, because outwardly extending rim 42 is in continual and slidable engagement with the interior wall of the next largest segment, each segment 40 can be adjusted to a virtually infinite number of positions, thereby allowing the telescoping handle portion 25 to provide a virtually limitless number of extension positions. Alternatively, the entire exterior wall of each segment 40 can continually slide along an interior wall of a segment having a larger diameter, the frictional interaction between the two walls allowing the segments to be adjusted and secured to a virtually limitless number of lengths. Preferably, the segments 40 have a circular cross sectional shape. One of the segments 40 is securable to the main handle and can be received partially or completely within the main handle 24. Alternatively, one of the segments 40 can be in a sliding relationship with the main handle 24. As another alternative, the main handle 24 can be eliminated completely such that one of the segments 40 of the telescoping portion 25 is directly connected to the head portion 22, and at least another of the portions 40 telescopically engages this secured portion.

Figure 3:
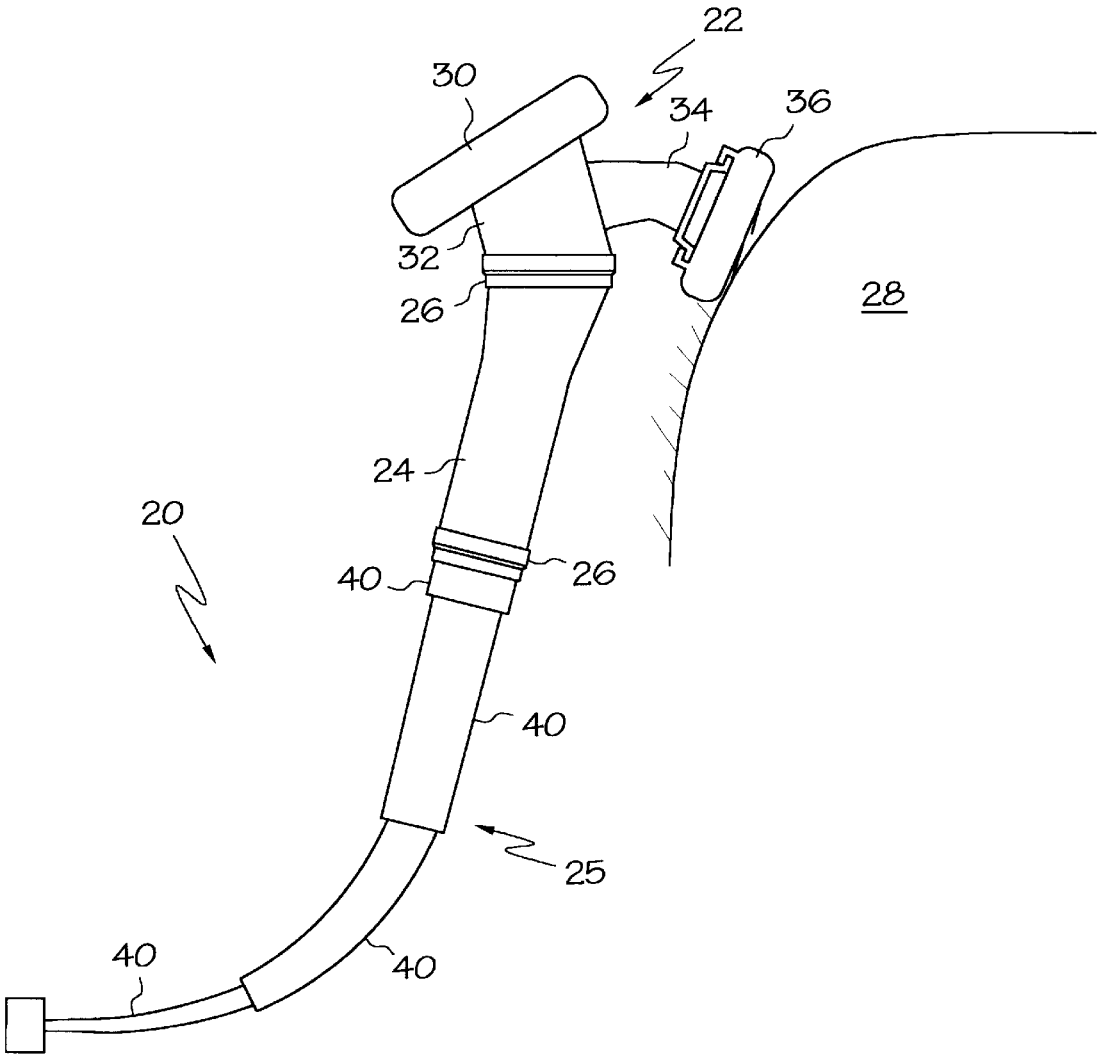
FIG. 3 is a side view of the razor of FIG. 1, illustrating the flexible nature of the extendable handle as the razor shaves.

As shown in FIG. 3, the telescopically extendable portion 25 is preferably flexible so that the blades of the blade cartridge 36 conform closely to the contours of the body portion 28 being shaved, and so as to adapt to a variety of shaving needs and a variety of users. Preferably, the telescoping handle portion 25 is made of a flexible, resilient, rust-resistant metallic material such as an aluminum composite, a chrome-plated copper, or flat spring steel. An elastic and flexible plastic material can also be used. As shown in FIG. 3, the material chosen allows the telescoping handle portion 25 to flex and bend during the shaving operation so as to be completely adjustable to the shaving needs of the user, and the various positions in which it is used. When the shaving operations are completed, the telescoping handle portion 25 retains its substantially straight shape due to the spring-like resiliency of the handle, as shown in FIG. 1.

Figure 4:
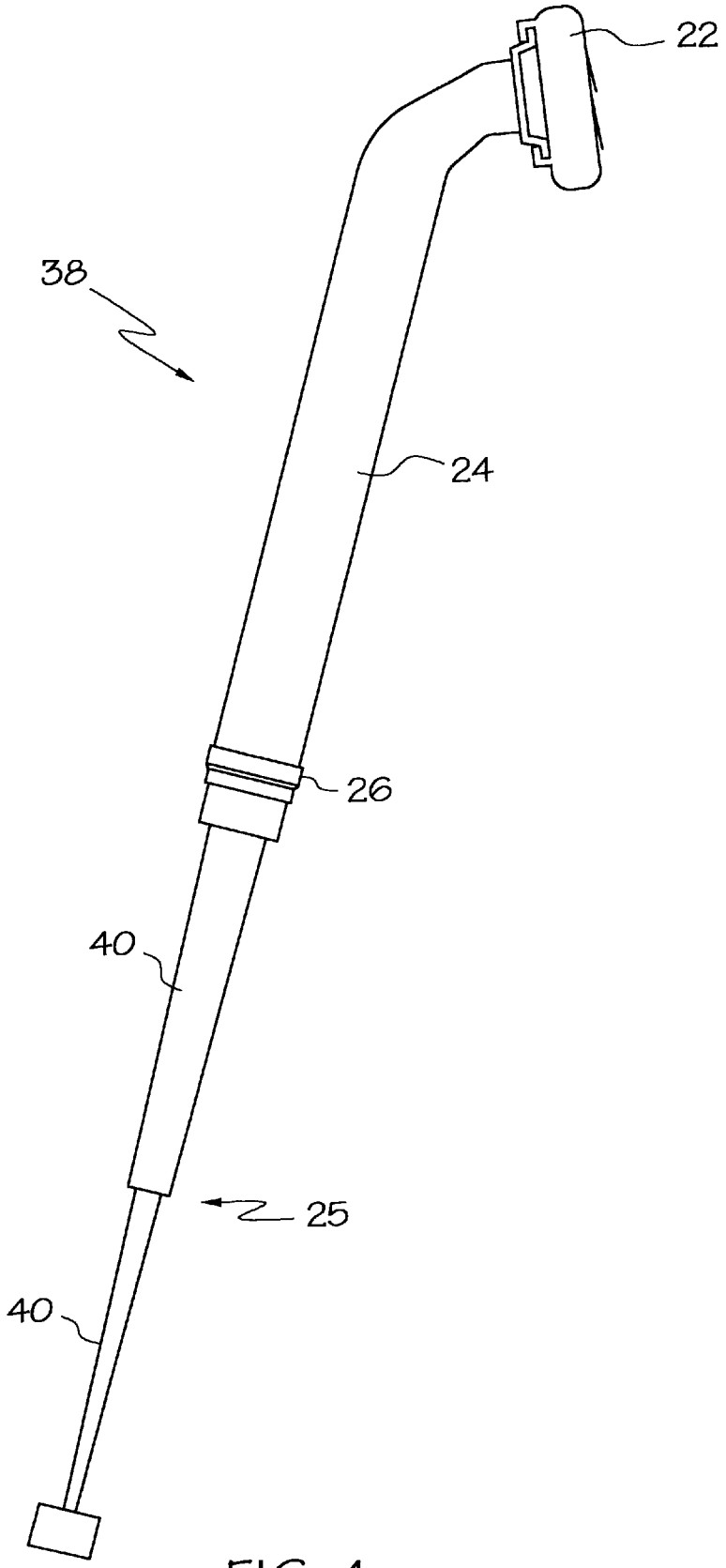
FIG. 4 is a side view of a removable extendable handle as applied to a disposable razor, according to another embodiment of the present invention.

FIG. 4 is a side view of another embodiment of the present invention wherein the telescoping handle portion 25 is detachably engaged with a disposable razor 38 having a main handle portion 24 and a head portion 22. The handle portion 24 of the disposable razor 38 is attached to the extendable handle portion 25 by a brace member 26, such as a locking ring for example. Accordingly, when the razor blade mounted on the head portion 22 becomes worn, the locking ring 26 can be unlocked so that the disposable razor 38 can be discarded and the extension handle 25 can be applied to a new disposable razor. As in the embodiment of FIGS. 1–3, the telescoping handle portion 25 of FIG. 4 is preferably capable of being slidingly adjusted to a number of extension positions to accommodate the particular user. It is also preferred that the handle portion 25 is made of a flexible and elastic material, to thereby provide a close and comfortable shave. The telescoping handle portion 25 can also be pivotally mounted to the disposable razor 38, such as through a pivot pin assembly mountable to the locking ring 26, so that the razor 38 can be pivoted to a variety of positions with respect to the handle portion 25.

Figure 5:
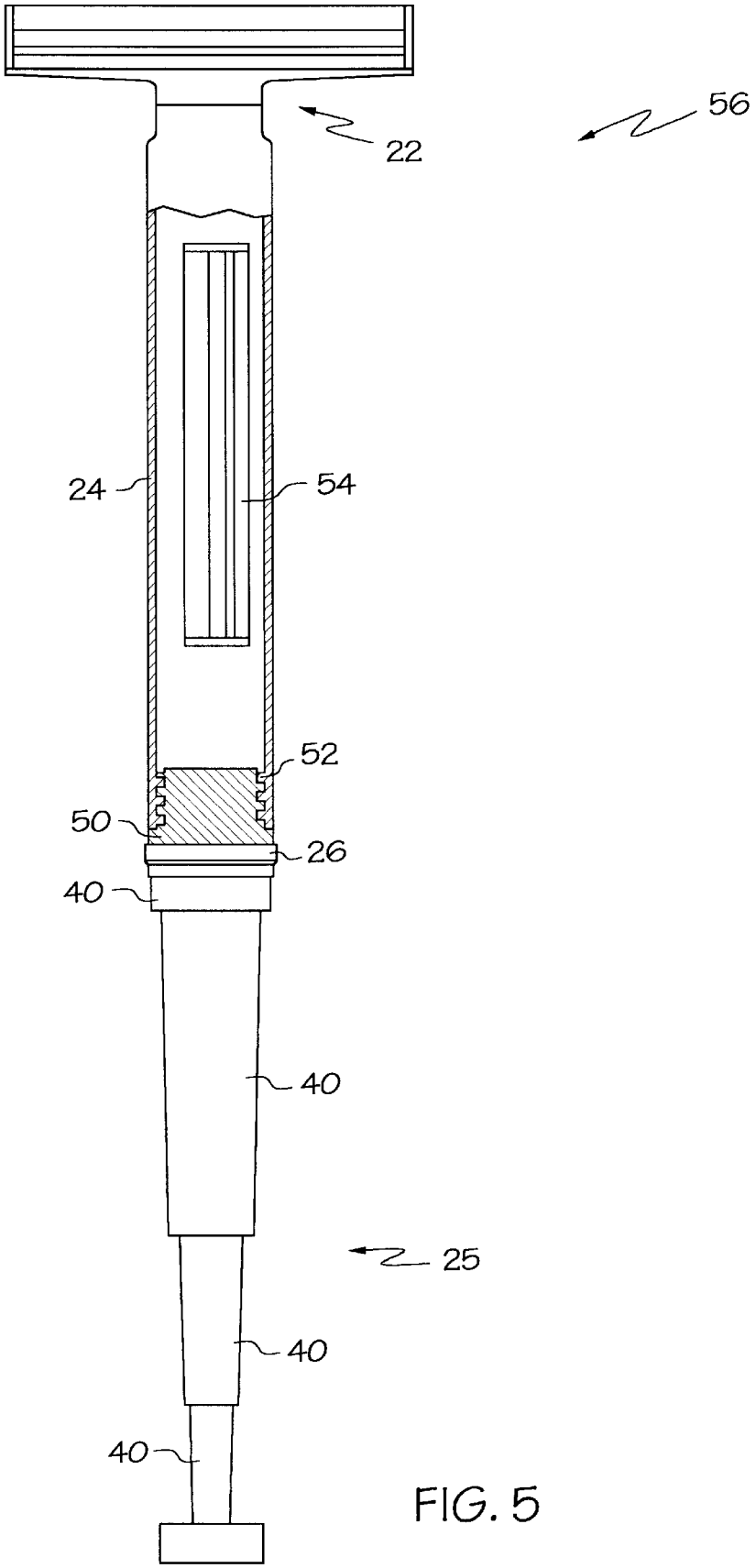
FIG. 5 is a partially broken-away front view of another embodiment of the present invention, illustrating a hollow storage compartment within the interior of the razor.

FIG. 5 is a front view of a third embodiment of the present invention, wherein the telescoping handle portion 25 (or extension handle) is mounted to a threaded cap 50. In this embodiment, the cap 50 is threadably engageable with the hollow main handle portion 24 of a razor 56 having a head portion 22. The bottom end of the main handle portion 24 has threads 52 for engaging the threads of the threaded cap 50. Thus, this embodiment allows the hollow handle portion 24 to serve as a storage compartment for razor supplies 54, such as gels, lotions, razor blade cartridges and the like. During use, the extendable handle portion 25 can be adjusted to the desired length according to the needs of the user. The cap 50 can be unscrewed from the handle portion 24 (with or without the handle portion 25 attached) to allow access to the hollow compartment within the main handle portion 24, such that the shaving supplies 54 can be deposited or retrieved. The head 22 of the razor 56 operates similar to any razor known in the art, and can be pivoting or adjustable as well as have suspended or pivoting blades.

Figure 6:
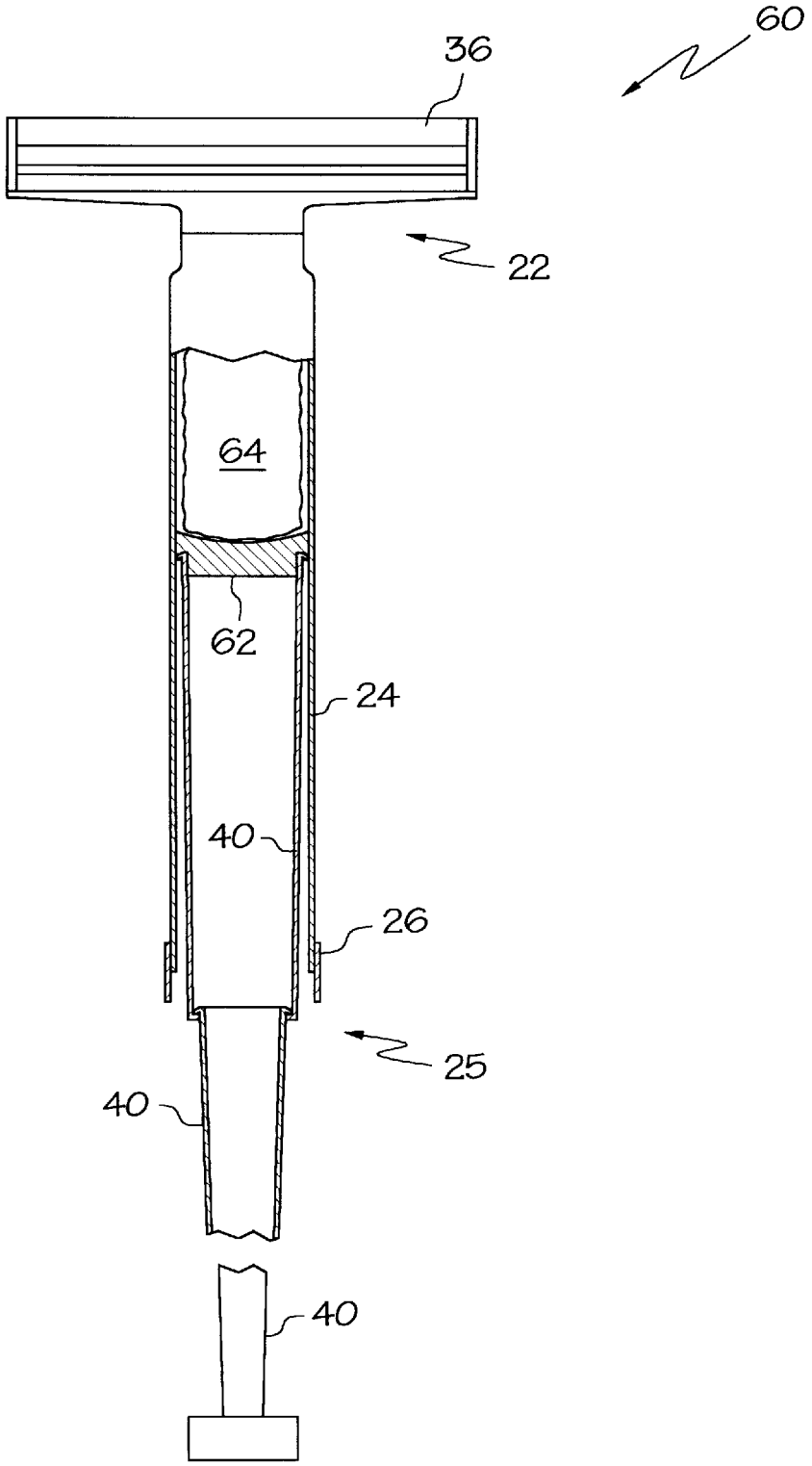
FIG. 6 is a partially broken-away front view of another embodiment of the razor of the present invention, wherein a plunger member is fitted to the telescoping handle to allow for the application of shaving cream through the razor head.

In another embodiment, shown in FIG. 6, the razor 60 has a hollow main handle portion 24 in which shaving cream or gel 64 can be placed. The telescoping handle portion 25 can be fitted with a plunger portion 62 for forcing the cream 64 through the head portion 22, such as through the sponge applicator (not shown), for application to the user's body. The plunger portion is preferably made of rubber, or other material suitable for forcing the cream 64 through the head portion 22 and maintaining a seal with the interior wall of the main handle portion 24.

The telescoping handle portion 25 operates as described above, and is preferably flexible yet elastic and capable of being extended to an infinite number of positions. The portion 25 can be held at the base of the handle portion 24 by a locking ring 26. When it is desired to apply shaving cream 64 to the user's body, the locking ring 26 can be loosened, the extendable portion 25 removed, and the shaving cream deposited into the hollow handle portion 24. The extendable handle portion 25 can then be slid inwardly toward the head 22 of the razor. When the plunger reaches the shaving cream 64, it pushes the cream out through the sponge applicator (not shown) of the head portion 22, which is in fluid communication with the hollow handle portion 24. Alternatively, the shaving cream 64 could be pushed through the blade cartridge 36 of the head 22. When the application of the cream 64 is completed, the handle portion 25 can be moved backwardly toward the base of the handle 24 and away from the head portion 22, and then re-secured by tightening the locking ring 26. It should be understood that a number of devices could be utilized to secure the telescopic handle 25 to the main handle 24, in addition to or in lieu of a locking ring 26.

It is contemplated that the plunger portion 62 could be secured to a separate telescoping piece which is retractable and/or removable from the other telescoping segments 40. Alternatively, the plunger portion 62 could be provided on a segment which snaps on to the razor body and can be removed and inserted into the razor handle during use.

Accordingly, the present invention provides a telescoping handle for extending the reach of razors, which can be adjusted to a wide variety of lengths and positions and which is flexible to provide a close shave. The telescoping handle allows the user to reach various body parts without discomfort. For example, a man who has difficulty in moving his arms, such as through arthritis or other crippling disability, could use this razor to comfortably shave his facial hair. The razor head could be controlled easily and comfortably from the waist of the man, without requiring him to raise his arms. The telescoping handle can be applied to a number of razors, such as fully disposable razors or non-disposable razors having disposable blade cartridges. The razor may include a variety of features, such as a pivoting head or blades, as are known in the art. The present invention also provides a storage compartment within the hollow handle for storing shaving supplies as well as a plunger portion connected to the extendable handle for forcing shaving cream through the hollow handle and out the head of the razor.

The embodiments of the invention illustrated in the drawings were chosen and described in order to best illustrate the principles of the invention and its practical application to thereby enable one of ordinary skill in the art to best utilize the invention in various embodiments and with various modifications as are suited to the particular uses contemplated. For example, it is contemplated that different types of brace members and locking devices could be used to secure the extendable handle portion to the main handle portion of a razor. It is also contemplated that, while the figures show the outermost telescoping segment being connected to a razor, the innermost segment could be connected instead. Moreover, the razor head and handle could be integrally molded, or could comprise separate, connectable parts. Therefore, the scope of the present invention should be considered in terms of the following claims and should not be limited to the details of the structures and methods shown and described in the specification and drawings.

What is claimed is:

1. An extendable razor for shaving hair from a body, comprising:

a head portion, said head portion being adapted to secure at least one razor blade for shaving hair from a body, said at least one razor blade having a sharp edge portion for extending from said head portion; and an extendable handle portion connectable to said head portion and extendable therefrom, the extendable handle portion having:

a first segment; and at least one telescoping segment that telescopically engages with said first segment, said at least one telescoping segment having a sliding surface that is slidingly movable and continuously frictionally securable with respect to a sliding surface of said first segment, whereby said at least one telescoping segment can be slid and frictionally held to a plurality of partially extended positions with respect to said first segment through the frictional contact of the sliding surfaces, wherein said at least one telescoping segment comprises a flexible and resilient material.

2. The razor of claim 1, wherein the first segment comprises a main handle having a first end which is secured to said head portion and a second end from which said at least one telescoping segment can extend.

3. The razor of claim 1, wherein said extendable handle portion comprises a main handle having a first end which is secured to said head portion and a second end from which said at least one telescoping segment can extend, wherein the first segment is secured to the main handle.

4. The razor of claim 3, wherein said main handle has a hollow compartment disposed therein and being accessible from the exterior of the main handle.

5. The razor of claim 4, wherein the hollow compartment is adapted for receiving shaving articles.

6. The razor of claim 5, further comprising:

a cover sealingly connectable with said main handle for allowing access to said hollow compartment, wherein said cover is movable from a closed position for sealing off said hollow compartment to an open position for allowing access to said hollow compartment.

7. The razor of claim 1, wherein said extendable handle portion comprises a main handle having a first end which is secured to said head portion and a second end from which said at least one telescoping segment can extend, wherein the first segment is receivable within said main handle and is slidingly movable with respect thereto.

8. The razor of claim 1, wherein the head portion further comprises an applicator for applying a substance to a user's body.

9. The razor of claim 1, wherein the head portion further comprises a cartridge holder for securing a removable razor blade cartridge, said blade cartridge having at least one razor blade secured thereto.

10. The razor of claim 9, wherein the blade cartridge is pivotally movable with respect to said cartridge holder when secured thereto.

11. The razor of claim 1, wherein the first segment has a hollow compartment in fluid communication with said head portion for receiving a shaving substance, and wherein the razor further comprises:

a plunger member connected to said at least one telescoping segment, wherein said plunger member is slidingly movable with respect to said first segment for forcing a substance from said hollow compartment through said head portion.

12. The razor of claim 1 wherein the first segment has an average diameter which is larger than the average diameter of the telescoping segment, and wherein the first segment is secured to the head portion.

13. The razor of claim 1, wherein the extendable handle portion and the head portion are integrally connected.

14. A disposable razor having a telescoping extension handle for extending the reach of the razor, said razor comprising:

a first segment securable to the handle of the razor; and at least one telescoping segment that is telescopically engageable with said first segment, said at least one telescoping segment having a sliding surface that is slidingly movable and continuously frictionally securable with respect to a sliding surface of the first segment, whereby said at least one telescoping segment can be slid and frictionally secured to a plurality of partially extended positions with respect to the first segment through the frictional contact of the sliding surfaces, wherein said at least one telescoping segment comprises a flexible and resilient material.

15. The razor of claim 14, wherein the first segment is adapted for being received within the handle of the razor.

16. The razor of claim 14, wherein the first segment is adapted for being fixedly secured to the handle of the razor.

17. The razor of claim 16, wherein the first segment has a hollow end for receiving the handle of the razor and being secured thereto.

18. The razor of claim 16, further comprising:

a locking member for temporarily securing said first segment to the handle of the razor.

* * * * *

UNITED STATES PATENT AND TRADEMARK OFFICE

CERTIFICATE OF CORRECTION

PATENT NO. : 5,911,480
DATED : June 15, 1999
INVENTOR(S) : Danny K. Morgan

It is certified that error appears in the above-indentified patent and that said Letters Patent is hereby corrected as shown below:

Claim 1, column 6, line 50 after "material" insert --, whereby said at least one telescoping segment flexes and bends during shaving operations to conform to user's shaving needs, and upon completion of the shaving operations said at least one telescoping segment returns to its substantially straight shape due to its resiliency --.

Claim 14, column 8, line 19 after "material" insert --, whereby said at least one telescoping segment flexes and bends during shaving operations to conform to user's shaving needs, and upon completion of the shaving operations said at least one telescoping segment returns to its substantially straight shape due to its resiliency --.

Signed and Sealed this

Second Day of November, 1999

*Attest:*

Q. TODD DICKINSON

*Attesting Officer*

*Acting Commissioner of Patents and Trademarks*